United States Patent [19]

Bartesaghi

[11] Patent Number: 4,460,169

[45] Date of Patent: Jul. 17, 1984

[54] DEVICE FOR PACKING SHEET-LIKE ELEMENTS

[76] Inventor: Angelo Bartesaghi, 22, via Caduti a Fossoli, Lecco (Como), Italy

[21] Appl. No.: 360,091

[22] Filed: Mar. 19, 1982

[30] Foreign Application Priority Data

Mar. 27, 1981 [IT] Italy ..... 20764 A/81

[51] Int. Cl.[3] ..... B65H 31/12; B65H 29/26

[52] U.S. Cl. ..... 271/192; 271/217

[58] Field of Search ..... 271/173, 184, 192, 218, 271/217; 414/45, 81, 79

[56] References Cited

U.S. PATENT DOCUMENTS

| | | | |
|---|---|---|---|
| 2,794,637 | 6/1957 | Rugg | 271/192 |
| 3,056,321 | 10/1962 | Walsh | 271/218 X |
| 3,306,609 | 2/1967 | Beuck | 271/192 |
| 3,643,816 | 2/1972 | Jacobsen | 271/218 X |
| 4,384,813 | 5/1983 | Smith et al. | 271/192 X |

*Primary Examiner*—Douglas C. Butler
*Assistant Examiner*—Lisa M. Rosenberg
*Attorney, Agent, or Firm*—Millen & White

[57] ABSTRACT

To ensure a uniform formation in packets with a predetermined number of elements, of sheet-like elements, for example, paper handkerchieves, two counter-rotating bodies are provided, presenting movable blades which, cooperate to receive each sheet-like element coming from a feeding group. Each pair of blades lays down a sheet-like element on a packet to be formed, on its turn supported by fins carried by belts or chains vertically moving downward, starting from the counter-rotating bodies and synchronically with the latter, in such a way that the packet to be formed lowers until the desired number of elements is received, and it is then ejected parallel to the axes of the rotating bodies.

11 Claims, 4 Drawing Figures

DEVICE FOR PACKING SHEET-LIKE ELEMENTS

BACKGROUND OF THE INVENTION

1. Field of the Invention

The present invention relates to a device capable of gathering sheet-like elements, which have been cut to size and folded, and of placing them in reciprocal superimposition as to form packets, each packet comprising a predetermined number of elements. The invention is particularly suitable for gathering and forming packets of paper handkerchieves or napkins, but it can also be applied to any other use which involves the need of for rapidly, exactly and reliably forming packets of sheet like elements, especially of paper.

2. Description of the Prior Art

To carry out the above mentioned operations, downstream of a cylinder for cutting and folding the sheet-like elements, there are provided, according to the known prior art techniques, devices capable of receiving the elements, already cut and folded, so as to form a packet. Each packet is divided from the subsequent one by means of a tooth or dividing head, which must follow a relatively complex run to reach its packet defining position, and follows the latter as far as to a location where a station is reached wherein the packet is placed into a container, and is then returned to the station of packet formation. This system with teeth, therefore, not only results in an intrinsically complicated system and a source of drawbacks and limitations of use, but it is also such as to not constantly ensure a perfect formation of the packets with the desired number of sheet-like elements and with a perfect alignment thereof. In fact, a higher or lower reciprocal compression of the elements in the station of the packet formation can cause errors in the number of elements constituting the packets, while the insertion of the dividing tooth can cause undesired foldings or local tearings of the sheet-like elements.

SUMMARY OF THE INVENTION

Therefore, an object of the present invention is to provide a device of the cited type, and which functions to allows the forming of packets of sheet-like elements with the highest reliability, both in what concerns the exact superimposition of the elements and in what concerns the number of elements forming each packet, independently, at least within certain limits, from the thickness of each cut and folded sheet-like element, and therefore, from the final thickness of the formed packet. Everything, of course, must be such as to comply with the need requirement of a high productivity as typical of the machines which perform the cited operations of cutting, folding and packaging sheet-like elements such as paper handkerchieves or napkins.

Essentially, the device according to the invention comprises, downstream of a group feeding in sequence the sheet-like elements, a blade rotating distributor, capable of receiving each element coming from the feeding group and, by subsequent rotations, of laying down said elements in superimposition on a means for supporting and forming the packet. The means for supporting and forming the packet is movable starting from the distributor, in the same vertical direction of the distribution of the sheet-like elements, the feeding of said sheet-like elements, the rotations of the distributor and the movements of means supporting and forming the packet being coordinated and made in synchronism.

In a preferred embodiment, the device is made up of a couple of bodies rotating parallel to the plan of packet formation, each presenting blades to receive, in horizontal position, each sheet-like element, and to feed in sequence the elements to the packet to be formed. It is then possible to reliably obtain a perfect positioning of the sheet-like elements, in relation to the feeding characteristics of same by the feeding group, and above all it is possible to reliably obtain the formation of a packet having an exact number of sheet-like elements, in that each packet is defined and separated from the adjacent ones by means of supporting fins which move synchronically and in coordination with the blades of the counter-rotating bodies.

DESCRIPTION OF THE PREFERRED EMBODIMENTS

Figure 1:
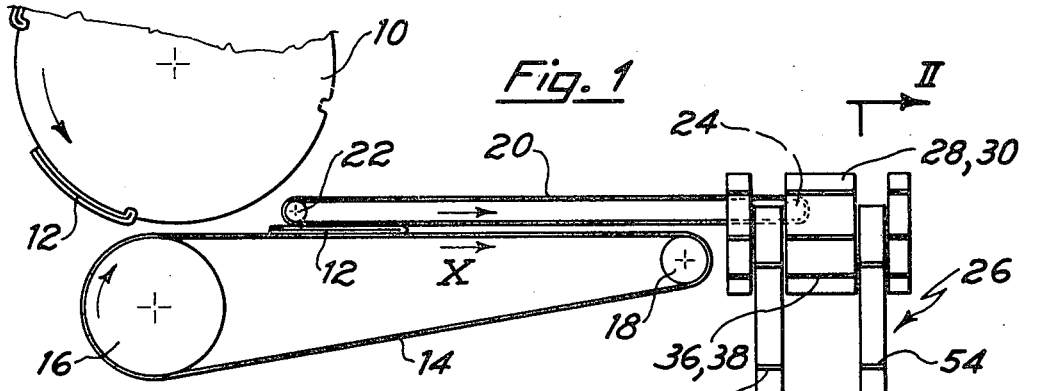
FIG. 1 is a diagrammatic side view of a device for gathering and forming packets according to the invention, in a machine for cutting, folding and packaging paper handkerchieves or napkins.

Referring to the drawings, the device is placed downstream of a known prior art cylinder 10 for forming and folding, for instance, paper handkerchieves, which sends said handkerchieves 12 to a conveyor 14, moving on rolls 16 and 18. It must be noted that the following description will be made with reference to paper handkerchieves, but it must be kept in mind that the same may apply to any type of sheet-like element to be submitted to the operations that will be described.

Said cylinder 10 sends the folded handkerchieves 12 to the conveyor 14 with a determined constant frequency, and said handkerchieves 12 are fed in the direction X at a constant speed, too, preferably with the help of an upper conveyor 20 moving on rolls 22 and 24. As can be seen in FIG. 1, the transmission roll 18 of conveyor 14 is placed upstream of the device, generally indicated by 26, receiving the handkerchieves 12, while the transmission roll 24 of the upper conveyor penetrates into the device 26 to accompany each handkerchief to the position where it is taken by said device 26.

Figure 2:
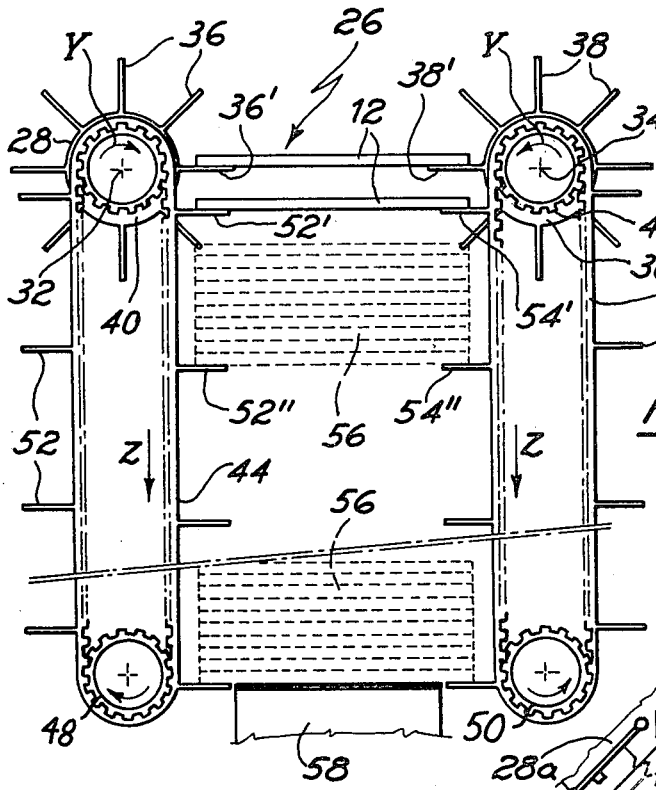
FIG. 2 is a cross-section according to line II—II of FIG. 1.

The latter is essentially constituted, as it can be particularly seen in FIG. 2, by two bodies 28 and 30 rotating around horizontal axes 32 and 34 parallel to the direction X from which the handkerchieves 12 come. Each body 28 and 30 has a series of plane and straight blades 36 and 38 angularly equidistant between each other and capable of placing themselves, during the rotation of the bodies 28 and 30, in the indicated directions Y, particularly in the position indicated by 36' and 38' in FIGS. 2 and 3, where said blades define a horizontal plane to receive and keep the handkerchief 12 which has been placed on them by the conveyors 14 and 20.

Each rotating body 28 and 30 is provided with one or more toothed areas 40 and 42 with which corresponding toothed belts 44 and 46 engage, said belts moving between the rotating bodies 28 and 30 and the corresponding toothed transmission rolls 48 and 50, placed vertically below said rotating bodies 28 and 30. The belts 44 and 46 are provided with a series of supporting fins 52 and 54 externally protruding from the belt, as indicated by 52', 54' or 52" and 54", and designed to align themselves two by two, and to form a corresponding number of moving planes to receive the packets. For this purpose, the fins 52 and 54 coincide with the blades 36 and 38, in that each fin 52 or 54 becomes coplanar with one of the blades 36 and 38 during its rotation around the body 28 or 30. Moreover, the distance between the fins 52 or 54 of each belt is equal to n times the step between the blades 36 or 38, where n is the number of handkerchieves 12 forming a complete packet 56. In this way, the first element of each packet 56 is actually positively positioned on the supporting fins 52 and 54, while the subsequent elements of the packet are positioned one after the other by the blades 36 and 38, performing a free movement of extremely limited width, in that the packet to be formed lowers as new handkerchieves are placed on it. Finally, a complete reliability about the number of handkerchieves forming each packet is obtained, in that said number is determined by the number of blades 36 and 38 between two supporting fins 52 and 54 placed in sequence on the toothed belts 44 and 46. Therefore, the formation of the packet takes place with the maximum security and reliability, as well as with the maximum regularity of form, i.e. with a perfect alignment of the handkerchief edges practically independently from the production rate imposed by the machine.

The formed packets 56 lower together with the belts 44 and 46 in the vertical direction Z, until they reach a conveyor 58 which takes them away and sends the same to a packaging station, placed downstream.

Of course, in order that the device can correctly work, it is necessary to obtain a perfect synchronism and timing not only between the counter-rotating bodies 28 and 30 and belts 44 and 46, which is determined by construction and engagement of toothings, but also between the feeding of handkerchieves and therefore, between the cylinder 10, with the conveyors 12 and 20, on one side, and the counter-rotating bodies 28 and 30, on the other side, because when a handkerchief 12 arrives, a couple of blades 36' and 38' must be present in the horizontal position to receive it. Said synchronism can be achieved without difficulty by means of mechanical means connecting the movements of the bodies 28 and 30 with the movements of the cylinder 10 and eventually of conveyors 14 and 20.

Figure 3:
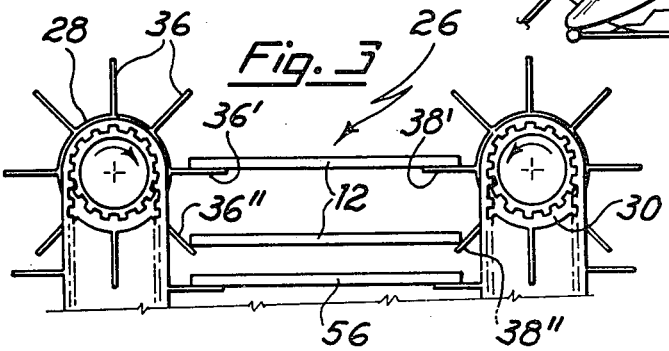
FIG. 3 is a partial cross-section corresponding to that of FIG. 2 and illustrating the device in another working position.

FIG. 3 illustrates the position of device 26 after the bodies 28 and 30 have rotated by a step with respect to the position of FIG. 2. As it can be clearly seen, the blades 36" and 38" are going to lay down a handkerchief 12 on the packet 56 which has to be formed, said operation occurring with the maximum of precision and with a handkerchief free run, until reaching the packet 56, which is reduced at a minimum.

Figure 4:
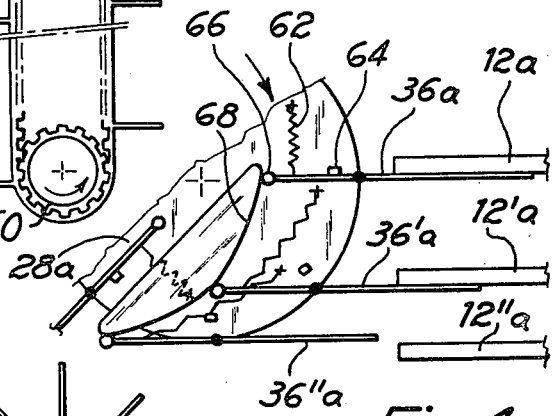
FIG. 4 is a partial and diagrammatic view of another embodiment of the device.

Especially in case of sheet-like elements 12*a* of a large size, for instance paper napkins, it can be advisable to have rotating bodies 28*a* with longer blades 36*a* and 38*a*. In this case, in order to avoid interferences and to better guide each sheet-like element 12*a* in its run downwards, the embodiment illustrated in FIG. 4 is optionally proposed, in which the blades 36*a* remain parallel to themselves along the entire run to support the elements 12*a*, as it is indicated in the sequence 12*a* and 12"*a*, 12"*a*, and 36*a*, 36"*a* and 36"*a* of the FIG. 4. This result can be obtained for example, by pivoting each blade 36*a* to the body 28*a* as indicated by 60, and by stressing the blade with a spring 62 against a clamp 64 defining its radial position. A cam follower 66 is placed at the inner end of the blade and glides in a fixed guide 68 which allows the blade 12*a* to remain palallel to itself as illustrated.

As already mentioned, the invention can be used not only for packaging paper handkerchieves or napkins, but also for packaging different sheet-like elements and the principles of the present invention can be achieved also by submitting the illustrated and described embodiments to several modifications and changes, without departing from the spirit and scope of the present invention.

I claim:

1. A device for gathering sheet-like elements, at least cut to size and optionally folded, in reciprocal superimposition to form packets having a predetermined number of sheet-like elements, the device comprising in combination:

(a) feed means for feeding said sheet-like elements at a constant speed and at constant intervals in a predetermined direction;

(b) distributing means for receiving said sheet-like elements from said feed means, and for vertically laying said sheet-like elements being received in superimposition to form a packet of a predetermined number of said sheet-like elements, and said distributing means comprising:

(1) a pair of counter-rotatable spaced parallel bodies, each having a corresponding plurality of planar straight projecting blades arranged for receiving each sheet-like element on a respective pair of said blades and for feeding each sheet-like element to form said packets by synchronous rotation of said counter-rotatable spaced parallel bodies, (2) a motion-transmitting means associated with each counter-rotating body, with a driving gear located below each counter-rotating body also associated with said each motion-transmitting means, for operatively moving each motion-transmitting means between said counter-rotating body and said driving gear, and each motion-transmitting means having a plurality of projecting fins, each capable of cooperating with a corresponding projecting fin of the other of said motion-transmitting means to form a means for supporting said packets being assembled, and (3) the fins, when horizontally aligned, being spaced from adjacent fins of the same motion-transmitting means by a distance equal to the height of the packets having a predetermined number of sheets to be formed, and the fins being arranged to be synchronized, when in the movement, with the movement of the blades of said counter-rotating bodies, and wherein the distance between two adjacent fins in the vertical direction is equal to n times the step between the blades of the counter-rotating bodies, with n being the number of sheet-like elements to form each packet; and (c) drive means associated with said feed means and said distributing means for feeding said sheet-like elements at a constant speed and frequency, and for driving said counter-rotating bodies at constant and equal angular speeds, one with respect to the other, and with the frequency of feeding the sheet-like elements being determined by the angular speed and the number of blades of the counter-rotating bodies, and in coordination with the movement of the blades.

2. A device as in claim 1, wherein said motion-transmitting means have a toothed surface, and said counter-rotating bodies and driving gears also have a toothed surface for engaging the toothed surface of said motion-transmitting means.

3. A device as in claim 2, wherein said fins are spaced from said blades by a distance sufficient to permit said sheet-like elements to arrive at said counter-rotating bodies and to permit feeding thereof to said fins, and said fins are spaced from each other in the vertical direction by an amount sufficient to permit arrival and ejection of the formed packets in a direction parallel to the axes of the counter-rotating bodies.

4. A device as in claim 3, wherein said blades are movable on said counter-rotating bodies, and wherein means are provided to define a blade trajectory such that the blades are maintained parallel with respect to each other at least in the portion of their path of movement wherein said sheet-like elements are received, supported and displaced.

5. A device as in claim 2, wherein said blades are movable on said counter-rotating bodies, and wherein means are provided to define a blade trajectory such that the blades are maintained parallel with respect to each other at least in the portion of their path of movement wherein said sheet-like elements are received, supported and displaced.

6. A device as in claim 2, wherein said motion-transmitting means is removable.

7. A device as in claim 1, wherein said fins are spaced from said blades by a distance sufficient to permit said sheet-like elements to arrive at said counter-rotating bodies and to permit feeding thereof to said fins, and said fins are spaced from each other in the vertical direction by an amount sufficient to permit arrival and ejection of the formed packets in a direction parallel to the axes of the counter-rotating bodies.

8. A device as in claim 7, wherein said blades are movable on said counter-rotating bodies, and wherein means are provided to define a blade trajectory such that the blades are maintained parallel with respect to each other at least in the portion of their path of movement wherein said sheet-like elements are received, supported and displaced.

9. A device as in claim 1, wherein said blades are movable on said counter-rotating bodies, and wherein means are provided to define a blade trajectory such that the blades are maintained parallel with respect to each other at least in the portion of their path of movement wherein said sheet-like elememnts are received, supported and displaced.

10. A device as in claim 9, wherein said means provided to define a blade trajectory comprise a spring and cam activating mechanism.

11. A device as in claim 1, further comprising transport means for receiving the formed packets and discharging them from said device for gathering sheet-like elements.

* * * * *